US007154032B2

(12) United States Patent
Burchfield

(10) Patent No.: US 7,154,032 B2
(45) Date of Patent: Dec. 26, 2006

(54) STRING ATTACHMENT SYSTEM APPARATUS AND METHOD FOR A STRINGED MUSICAL INSTRUMENT

(76) Inventor: Charles C. Burchfield, 12002 107th St. Ct. KPN, Gig Harbor, WA (US) 98329

( * ) Notice: Subject to any disclaimer, the term of this patent is extended or adjusted under 35 U.S.C. 154(b) by 0 days.

(21) Appl. No.: 11/191,548

(22) Filed: Jul. 28, 2005

(65) Prior Publication Data

US 2006/0021492 A1 Feb. 2, 2006

Related U.S. Application Data

(60) Provisional application No. 60/592,236, filed on Jul. 28, 2004.

(51) Int. Cl.
*G10D 3/14* (2006.01)

(52) U.S. Cl. ..... 84/304

(58) Field of Classification Search ..... 84/290, 84/297 R, 304

See application file for complete search history.

(56) References Cited

U.S. PATENT DOCUMENTS

| | | | | |
|---|---|---|---|---|
| 3,563,126 | A | 2/1971 | Cunnington | |
| 4,197,779 | A | 4/1980 | Holman | |
| 5,140,884 | A | 8/1992 | Bowden | |
| 5,295,427 | A | 3/1994 | Johnsen et al. | |
| 5,477,764 | A | 12/1995 | Carrico | |
| 5,739,444 | A | 4/1998 | Borisoff | |
| 5,969,279 | A | 10/1999 | Dickson, II | |
| 6,111,176 | A | 8/2000 | Rose | |
| 6,353,165 | B1 * | 3/2002 | Chiu et al. | 84/304 |
| 6,369,305 | B1 | 4/2002 | Powers et al. | |
| 6,608,248 | B1 * | 8/2003 | Sperzel | 84/306 |
| 6,613,968 | B1 | 9/2003 | Devereaux et al. | |
| 6,815,596 | B1 * | 11/2004 | Goto | 84/304 |
| 2002/0092404 | A1 | 7/2002 | Naimish | |
| 2003/0177883 | A1 | 9/2003 | Rose et al. | |

* cited by examiner

*Primary Examiner*—Kimberly Lockett
(74) *Attorney, Agent, or Firm*—William Forster

(57) ABSTRACT

A string attachment system for securing a string to a stringed musical instrument. The string attachment system includes a bridge pin having an elongate stem defining an outer surface formed for longitudinal mating insertion into a pin hole defined by the walls of a walled opening through a bridge assembly disposed on the body of an instrument. A passage is formed to extend transversely through the stem from a front entry point to a rear exit point. With this arrangement, the bridge pin can receive an end of a musical string through the front entry point, through the passage, and out through the rear exit point to enable the string to pass through the bridge pin and into the pin hole along with the stem of the bridge pin. A rear groove is formed in the outer surface by two planar walls intersecting to form a v-shaped groove for receiving the string.

20 Claims, 4 Drawing Sheets

102
104
98

26
60
20
32
24
118
116
112
114

98
100
92
94
96

FIG.5
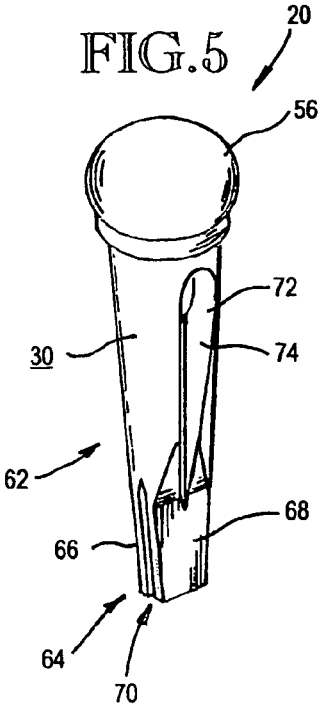
FIG.6
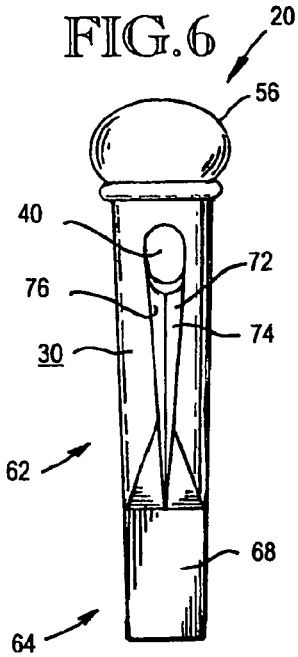
FIG.7
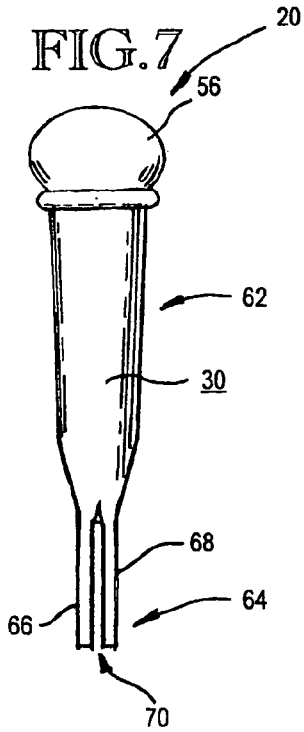
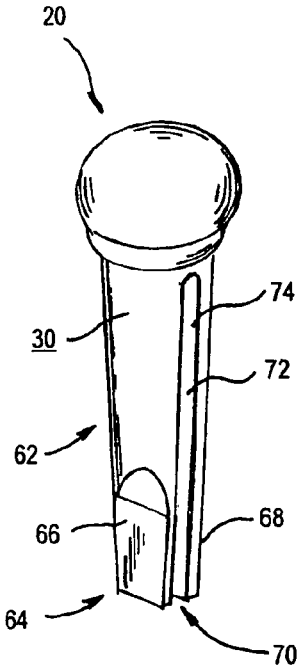
FIG.8
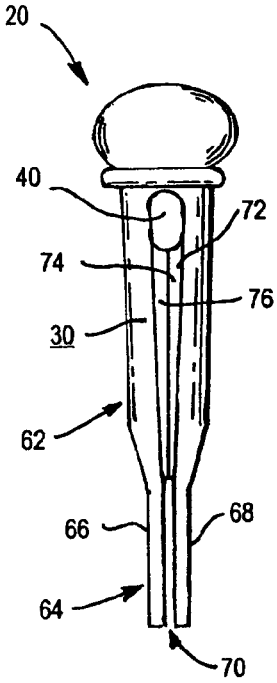
FIG.9
FIG.10
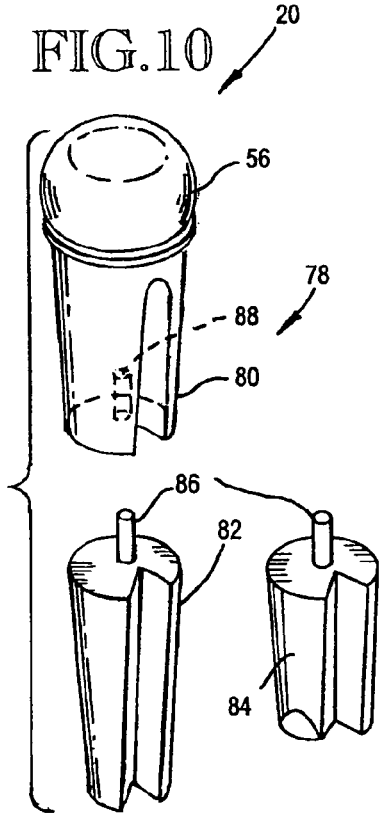

STRING ATTACHMENT SYSTEM APPARATUS AND METHOD FOR A STRINGED MUSICAL INSTRUMENT

This application claims the benefit of U.S. Provisional Application Ser. No. 60/592,236 filed Jul. 28, 2004.

BACKGROUND

This invention relates generally to stringed musical instruments, and more particularly to bridge pins, saddles and nuts provided for the support and attachment of strings to a stringed musical instrument.

Stringed musical instruments, and the components employed to support and attach the strings to the instrument are well known in the art and have undergone many advancements in recent years. For example, one such advancement is disclosed in U.S. Pat. No. 5,295,427 which issued in Mar. 1994 showing a bridge for string instruments for adjustably fastening the strings to the instrument body. However, because this device employs many adjusting parts, vibration transmitted from the strings is likely to diminish quickly thereby negatively effecting the quality of sound. Likewise, U.S. Pat. No. 5,477,764 issued in Dec. 1995 which illustrates an attachment mechanism having two quick attachment cylinders. This design is complicated by its plurality of parts which could interrupt the transfer of sound and vibration from the strings to the instrument.

In Apr. 1998, U.S. Pat. No. 5,739,444 issued having a design which incorporates a plurality of saddles secured to the bridge plate which are individually adjustable. Because of the multiple adjustments required, this design is overly cumbersome to tune and would likely make it difficult to maintain the quality of sound.

In addition, U.S. Pat. No. 5,969,279 issued in Oct. 1999 illustrating a saddle with multiple holes forming a plurality of sound-coupling pedestals. This design employs rectangular slots to receive the individual strings. Because the slots are rectangular, they are not formed to maximize the contact area of the string to the bridge. Similarly, U.S. Pat. No. 6,369,305 issued in Apr. 2002 illustrating a guitar bridge having a plurality of rectangular shaped slots with holes formed therein. Likewise, because this design employs rectangular slots, the surface contact area of a string extending through the same is not maximized.

Importantly, the transfer of vibration from the string to the instrument, to create the instrument's tone, is an important factor in the quality of sound produced from a stringed musical instrument. As noted above, none of the above cited designs provide a system of attachment between a string and the instrument to maximize the surface area of the string contacting the portion of the instrument that transfers the vibrations, and likewise to maximize the sound produced.

Accordingly, a need remains for an improved system of attachment of a string to a stringed musical instrument directed to increasing the contact surface area between the string and the points of attachment of the string to the instrument. For this purpose, an improved system including a bridge pin, saddles and nuts, or any combination thereof, for enhancing the quality of sound of a stringed instrument is provided.

SUMMARY

One object of the invention is to improve the sound generated from the transmission of string vibration to a stringed musical instrument thereby intensifying the quality of sound.

A second object is to increase the surface area of a string that contacts the bridge pin, saddle and nut of a stringed musical instrument.

Another object is to reduce the cost of string replacement on musical instruments.

Yet another object is to enable the strings of an instrument to maintain the generation of a sound created therefrom for a greater period of time.

A further object is to enhance the sound created by a stringed musical instrument.

Still another object is to improve the connection between a string and the musical instrument to which it is attached.

The invention is a string attachment system for securing a string to a stringed musical instrument, and includes a bridge pin adapted to secure and anchor one end of a musical string to a stringed musical instrument. Typically, the bridge pin comprises an elongate stem that defines an outer surface. With this construction, the stem is adapted for longitudinal insertion into a pin hole that is defined by the walls of a walled opening provided through a bridge assembly of a stringed musical instrument. In addition, the bridge pin is intended for removable engagement with the walls of the walled opening when the bridge pin is disposed through the pin hole.

Moreover, the stem is formed to define a passage extending transversely through the stem from a front entry point disposed on the outer surface, to a rear exit point disposed on an opposing portion of the outer surface. Accordingly, the bridge pin is adapted to receive an end, i.e. an anchored end of a musical string through the front entry point, through the passage, and out through the rear exit point to enable the string to pass through the bridge pin and into the pin hole along with the stem of the bridge pin.

Further, a longitudinally defined rear groove is formed on the outer surface of the stem to extend from the rear exit point, longitudinally away from rear exit point to provide a seat for portions of the string disposed between the bridge pin and the walled opening that defines the pin hole.

With this construction of a bridge pin, an end of a string can be frictionally secured and fixed to the musical instrument as the bridge pin is inserted into the pin hole to urge and force the string between a portion of the walls of the walled opening and the rear groove of the stem. Likewise, the additional contact created between the bridge pin and the string, by passing the string through the stem of the bridge pin, increases the string vibration transmitted to the musical instrument.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention.

BRIEF DESCRIPTION OF THE DRAWINGS

FIG. 5 is a perspective view of an alternate embodiment showing a bridge pin having a tapered stem formed with a forked or divided terminal end that defines opposing prongs disposed to extend into the instrument to create a sound enhancing tuning-fork type structure, wherein a string receiving rear groove is formed in the stem to extend from the rear exit point to one of the prongs, wherein the prong gap is oriented transverse to the rear groove.

FIG. 6 is a elevational view of an alternate embodiment showing a bridge pin having a tapered stem formed with a divided terminal end that defines opposing prongs disposed to extend into the instrument to create a sound enhancing tuning-fork type structure, wherein a string receiving groove is formed in the tapered stem and extends from the rear exit point, adjacent the passage, to one of the prongs, the pin receiving groove having distinct opposing walls that join to form a vee shaped groove extending longitudinally for wedging a string between the bridge pin and the walls of a walled opening provided through a bridge assembly, and wherein a passage through the stem of the bridge pin is provided for receiving a string through the bridge pin, wherein a portion of the passage is in communication with the groove so that the string can be received in and along the groove, wherein the prongs are oriented transverse to the passage and to the groove.

FIG. 7 is a elevational view illustrating the bridge pin of FIG. 6, rotated 90 degrees to show the opposing prongs, with the prongs oriented for alignment with the passage and with the longitudinally disposed groove.

FIG. 8 is a perspective view of an alternate embodiment showing a bridge pin having a tapered stem formed with a divided terminal end that defines opposing prongs disposed to extend into the instrument to create a sound enhancing tuning-fork type structure, wherein a string receiving groove is formed in the tapered stem and extends substantially from the rear exit point, to the prongs wherein the prongs are oriented for alignment with the groove and with the passage.

FIG. 9 is an elevational view of an alternate embodiment showing a bridge pin having a tapered stem formed with a divided terminal end that defines opposing prongs disposed to extend into the instrument to create a sound enhancing tuning-fork type structure, wherein a string receiving groove is formed in the tapered stem, and extends from a string passage, adjacent the pin head, to the prongs, the pin receiving groove having distinct opposing walls that join to form a 'v' shaped groove extending longitudinally for wedging a string between the bridge pin and the walls of a walled opening provided through a bridge assembly, and wherein a passage is provided through the bridge pin for receiving a string through the bridge pin, wherein the string can be received in and along the groove, with the prongs are oriented in alignment with the passage and to the groove.

FIG. 10 is a perspective view of an alternate embodiment showing a bridge pin having a tapered stem that comprises a stem base and a terminal end that is removably attached to the stem base, wherein the stem base is adapted for engagement with one or more detachable, dissimilarly formed terminal ends to form multiple configurations of a bridge pin, including the tuning-fork type structure with various orientations thereof.

DETAILED DESCRIPTION OF THE PREFERRED EMBODIMENTS

Figures 1, 1A:
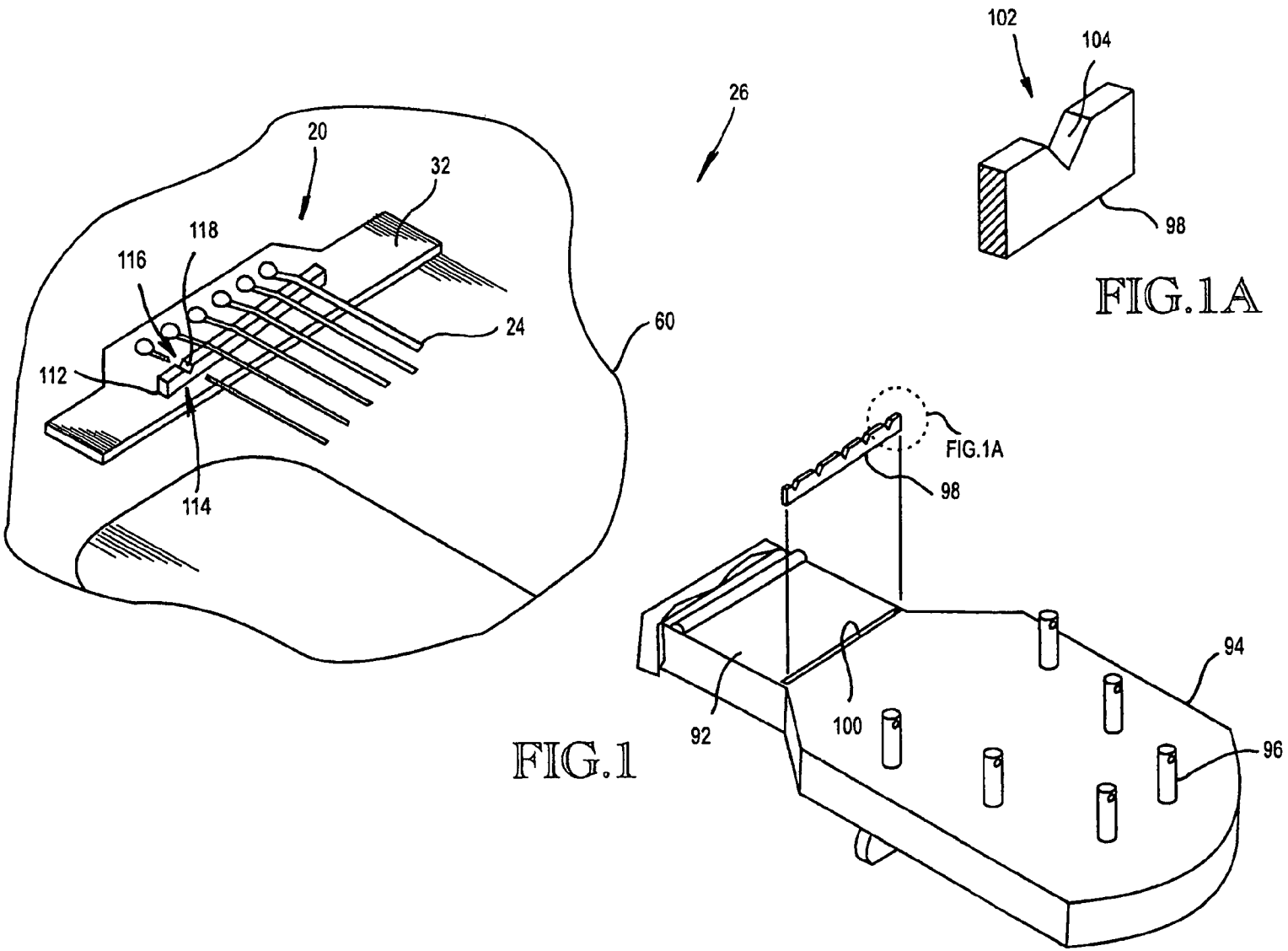
FIG. 1 is a fragmentary perspective view of a stringed musical instrument illustrating portions of the body broken away from the neck and peg head extending from the neck, with the body of a stringed musical instrument having a bridge assembly secured to the outer surface of the body of the stringed musical instrument, such as a guitar, wherein a plurality of tensioned strings extend over a bridge saddle, with one end of each string being secured to the instrument by a common tapered bridge pin that is wedged within a pin hole to secure the string to the instrument, and wherein a nut is exploded from a slot in the neck.
FIG. 1A is a partial perspective view of a nut having v-shaped grooves, each formed to receive and support an individual string.

Referring now to the illustrations, FIGS. 1 through 11 show various configurations of a string attachment system for securing a string to a stringed musical instrument. Included therein is a bridge pin 20 adapted to secure and anchor one end 22 of a musical string 24 to a stringed musical instrument 26. Typically, the bridge pin 20 comprises an elongate stem 28 that defines an outer surface 30. With this construction, the stem 28 is adapted for longitudinal insertion into a pin hole 32 that is defined by a wall 34 of a walled opening 36 provided through a bridge assembly 38, and through portions of the musical instrument 26. In addition, the bridge pin 20 is intended for removable engagement with the wall 34 of the walled opening 36 when the bridge pin 20 is disposed through the pin hole 32.

Moreover, the stem 28 is formed to define a passage 40 extending transversely through the stem 28 from a front entry point 42 disposed on the outer surface 30, to a rear exit point 44 disposed on an opposing portion of the outer surface 30. Accordingly, the bridge pin 20 is adapted to receive an end 22, i.e., an anchored end of a string 24 through the front entry point 42, through the passage 40, and out through the rear exit point 44 to enable the string to pass through the bridge pin 20 and into the pin hole 32 along with the stem 28 of the bridge pin 20.

Figure 4:
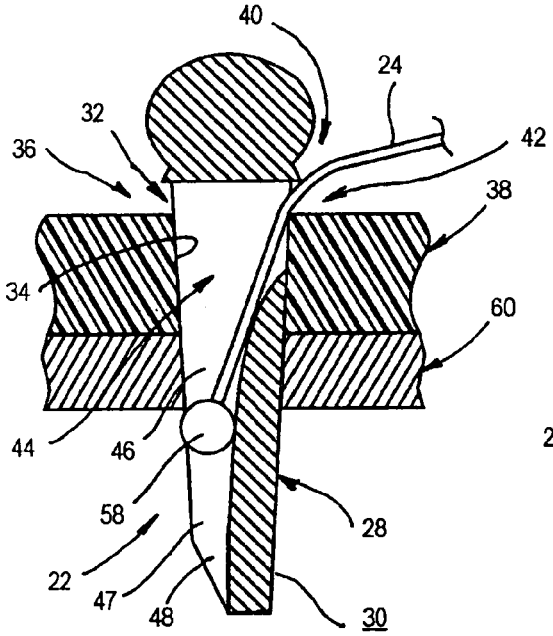
FIG. 4 is an sectional view taken along 4—4 of an embodiment of the invention illustrating a string disposed through a passage formed through the stem of a bridge pin, the bridge pin being wedged within a bridge pin hole.
Figure 3:
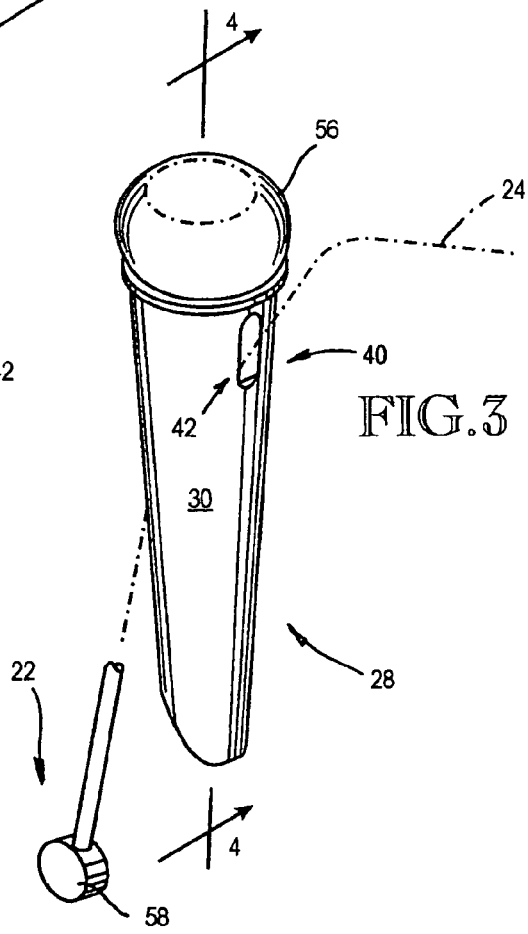
FIG. 3 is a perspective view of a bridge pin formed with a passage extending transversely through the stem of the bridge pin for receiving a string through the bridge pin, wherein a portion of the passage is in communication with a longitudinally disposed groove so that the string can be received in and along the groove.
Figure 11:
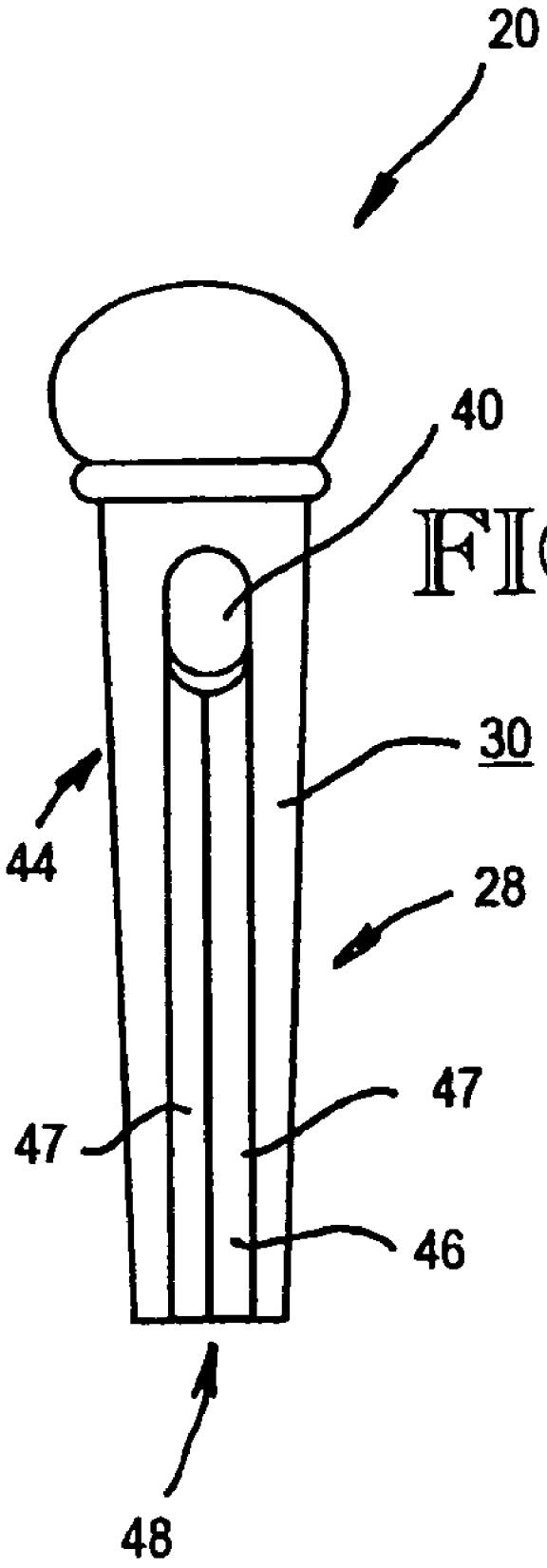
FIG. 11 is an elevational view of an a bridge pin as illustrated in FIGS. 2 and 3 having a tapered stem formed with a passage extending transversely through the stem of the bridge pin for receiving a string through the bridge pin, wherein a portion of the passage is in communication with a longitudinally disposed groove formed by the intersection of planar walls so that the string can be received in and along the groove.

Further, as best illustrated in FIGS. 3, 4 and 11, a longitudinally defined rear groove 46 is formed on the outer surface 30 of the stem 28 to extend from the rear exit point 44, longitudinally away from rear exit point 44 to provide a seat 48 for portions of the string 24 disposed between the bridge pin 20 and the walled opening 36 that defines the pin hole 32. As will be discussed more fully below, the rear groove 46 is defined by a portion of the outer surface and formed by two planar walls 47 intersecting to form a v-shaped groove for receiving the string 24 in the groove 46, along the planar walls 47.

In this way, an end 22 of a string 24 can be frictionally secured and fixed to the musical instrument 26 as the bridge pin 20 is inserted into the pin hole 32 to urge and force the string 24 between a portion of the wall 34 of the walled opening 36 and the rear groove 46 of the stem 28. Likewise, the additional contact created between the bridge pin 20 and the string 24, by passing the string 24 through the stem 28 of the bridge pin 20, increases the string vibration transmitted to the musical instrument 26.

Figure 2:
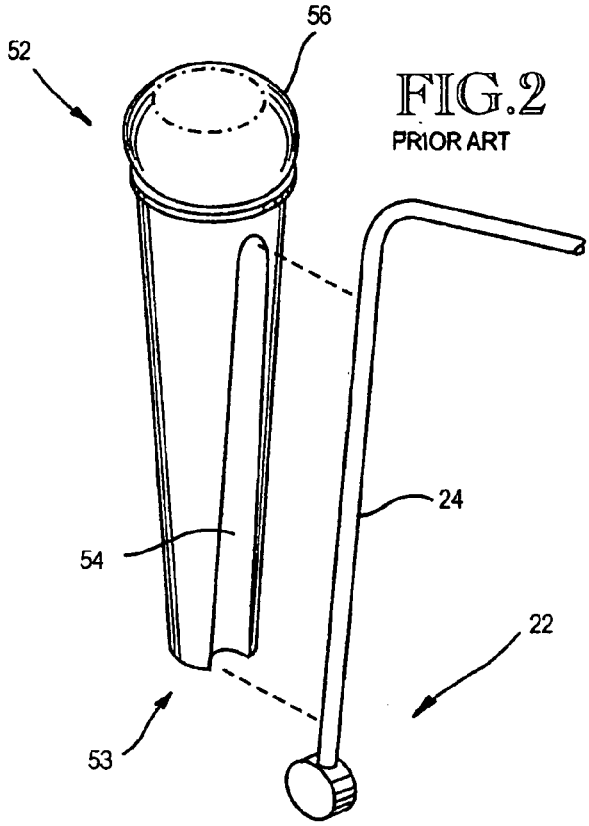
FIG.2 PRIOR ART
FIG. 2 is a perspective view of a common, prior art bridge pin having a groove for receiving a portion of a string, wherein an end of the string comprises a retaining ball disposed adjacent the tapered terminal end of a bridge pin wherein the retaining ball prevents the string from slipping through the groove in response to tension applied to the string.

Considering now in more detail the structure of the of a bridge pin 20, FIG. 2 illustrates the typical arrangement of a prior art bridge pin 52, which is substantially round in shape, and tapers toward its end 53. In addition, FIG. 1 shows a plurality of strings 24 attached to a bridge assembly 38 via a plurality of bridge pins 20. If this were a conventional arrangement, with a prior art bridge pin as illustrated in FIG. 2, the bridge pins would each be oriented with a groove 54 facing the string 24 as it enters into and through the bridge assembly 38.

In contrast, an embodiment of the present invention is further illustrated in FIGS. 3, 4 and 11 showing how the string 24 extends transversely through a substantially round, tapering bridge pin 20 as noted above. Specifically, FIG. 3 is a perspective view of a bridge pin 20 having a pin head 56 formed atop of a stem 28. In this embodiment the stem 28 is tapered, however, a stem having little or no taper (not illustrated) could be employed with some reduction in performance and sound transmission. Because most stringed instruments, like guitars, employ round, tapered bridge pins that fit into round tapered pin holes, the bridge pin 20 of the present invention is configured and shaped for use in such instruments.

Further, as best illustrated in FIG. 4, a string 24 is typically terminated with a ball 58 that is provided as an extra measure to insure that a string 24 cannot slip back through a bridge assembly 38. FIG. 3 also shows the increased contact between the string 24 and the bridge pin 20, of the present invention, as the string 24 extends through the passage 40.

With this construction, the position of the string 24 is directed through the bridge pin 20, to the rear thereof, and downward along the planar wall 47 of the rear groove 46. Accordingly, the tension of the string 24 helps to maintain an increased level of contact between the string 24 and the bridge pin 20. This way, the vibration from the string 24 is transmitted through the bridge assembly 38, to the body 60 of the musical instrument 26.

It should also be noted that the embodiment illustrated in FIG. 4 shows the passage 40 being in communication with a longitudinally disposed rear groove 46 so that the string 24 can be received in and along the same as it extends through the rear exit point 44. Accordingly, as the string 24 extends through the bridge assembly 38, and tensioned, it is urged toward the wall 34, and likewise toward the rear groove 46. In addition, because each string, that is strung on the instrument, varies in size, the rear groove 46 of the bridge pin comprises intersecting planar walls 47 that are formed to maintain the size of the groove throught its length as illustrated in FIG. 11. In this way, all the strings, of varying size, will fit therein.

Directing attention now to FIGS. 5 through 9, an alternate embodiment bridge pin 20 is presented where the stem comprises a tapered stem 62 formed with a divided or forked terminal end 64 that defines a pair of substantially planar opposing prongs 66, 68 disposed to extend into the musical instrument 26 to create a sound enhancing tuning-fork type structure, wherein a string receiving rear groove 72 is formed in the tapered stem 62 to extend from the rear exit point 44 to one of the prongs, wherein the prong gap 70 is oriented transverse to the rear groove 72.

Similarly, FIG. 6 is a elevational view of an alternate embodiment showing a bridge pin 20 having a tapered stem 62 formed with a divided or forked terminal end 64 that defines opposing prongs as noted above. Importantly, the pin receiving rear groove 72 includes distinct opposing planar groove walls 74, 76 that join to form a "V" shaped rear groove 72 extending longitudinally for receiving and wedging a portion of a string 24 between the groove walls 74, 76 of the bridge pin and the wall 34 of a walled opening 36 provided through a bridge assembly 38. It should also be noted that FIGS. 5 through 7 illustrate prongs 66, 68 oriented transverse to the passage 40, and to the rear groove 72.

Turning now to FIGS. 8 and 9, a similar embodiment is illustrated, however prongs 66, 68 are disposed for alignment with the rear groove 72. Accordingly, the prong gap 70 is aligned with the passage 40 as well as with the rear groove 72.

In another aspect of the invention, another embodiment is illustrated in FIG. 10 where a multi-part stem 78 is provided and comprises a stem base 80 and a removable terminal end 82 that is removably attached to the stem base 80. In this way, a bridge bin 20 can be quickly and easily modified to suit the users preferences. In this way, the stem base 80 is adapted for engagement with one or more detachable, dissimilarly formed removable terminal ends like removable terminal end 82, 84 to form multiple configurations of a bridge pin 20. For example, removable terminal end 82 is formed to extend a rear groove 72 into the terminal end. In contrast, removable terminal end 84 is configured to provide a forked-structure as noted above.

Additionally, it should be noted that the connection between the stem base 80, and a removable terminal end could be implemented in many various ways and, for the purposes of this disclosure, is not limited to any one method. However, a particularly effective method of connection is by a threaded extension 86 that extends from a portion of a removable terminal end 82, 84, that threadedly engages a threaded bore 88 formed in a portion of the stem base 80 as illustrated in FIG. 10.

Directing attention again to FIG. 1, additional components of a string attachment system are illustrated including a saddle 112 which fits into slot 114 defined on the bridge assembly 38, and a nut 98 which similarly fits into slot 100 defined on the neck 92 of an instrument of the type having a peg head 94 extending from the neck 92 for supporting a plurality of pegs 96. As noted above, improved string sound is produced by maximizing the contact area of the string with its supports. Accordingly, the saddle 112 comprises a plurality of v-type grooves 116 defined by intersecting planar saddle walls 118. Likewise, the nut 98 comprises a plurality of v-type grooves 102 defined by intersecting planar nut walls 104.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A string attachment system for securing a string to a stringed musical instrument, the string attachment system comprising:

a bridge pin having an elongate stem defining an outer surface, the stem being adapted for longitudinal insertion into a pin hole defined by the walls of a walled opening provided through a bridge assembly disposed on the body of a stringed musical instrument, wherein the bridge pin is in removable mating engagement with the walls when disposed through the pin hole;

the stem being formed to define a passage extending transversely through the stem from a front entry point disposed on the outer surface, to a rear exit point disposed on an opposing portion of the outer surface, the bridge pin being adaptable to receive an end of a musical string through the front entry point, through the passage, and out through the rear exit point to enable the string to pass through the bridge pin and into the pin hole along with the stem of the bridge pin;

the stem further comprising a longitudinally disposed rear groove defined by a portion of the outer surface and formed by two planar walls intersecting to form a v-shaped groove for receiving a string in the groove along the walls, the rear groove extending from the rear exit point, longitudinally away from rear exit point to provide a seat for portions of the string disposed between the bridge pin and the walled opening that defines the pin hole; and wherein an end of a string can be frictionally secured and fixed to the musical instrument as the bridge pin is inserted into the pin hole to urge and force the string between a portion of the walls of the walled opening and the seat formed by the rear groove of the stem.

2. A string attachment system as recited in claim 1 further comprising a bridge saddle for supporting strings at a spaced distance from the bridge assembly, the bridge saddle comprising a plurality of spaced v-shaped grooves defined by the intersection of two planar saddle walls, each groove disposed to receive one string through the groove so that a portion of the string is in contact with each planar saddle wall.

3. A string attachment system as recited in claim 2 further comprising a nut for supporting strings at a spaced distance from a neck that extends from the body of the instrument, the nut comprising a plurality of spaced v-shaped grooves defined by the intersection of two planar nut walls, each groove disposed to receive one string through the groove so that a portion of the string is in contact with each planar nut wall.

4. A string attachment system as recited in claim 1 further comprising a nut for supporting strings at a spaced distance from a neck that extends from the body of the instrument, the nut comprising a plurality of spaced v-shaped grooves defined by the intersection of two planar nut walls, each groove disposed to receive one string through the groove so that a portion of the string is in contact with each planar nut wall.

5. A bridge pin as recited in claim 1 wherein the stem comprises a stem base and a terminal end that is removably attached to the stem base.

6. A bridge pin as recited in claim 5 wherein the removable terminal end is threadedly attached to the stem base.

7. A bridge pin as recited in claim 6 wherein the removable terminal end comprises a structure having at lease two opposing prongs.

8. A bridge pin as recited in claim 1 wherein portions of the outer surface of the stem is tapered.

9. A bridge pin as recited in claim 1 further comprising a forked terminal end having at lease two opposing prongs.

10. A method of making a string attachment system for securing a string to a stringed musical instrument, the method comprising the steps:

providing a bridge pin having an elongate stem defining an outer surface, the stem being adapted for longitudinal insertion into a pin hole defined by the walls of a walled opening provided through a bridge assembly disposed on the body of a stringed musical instrument, wherein the bridge pin is in removable mating engagement with the walls when disposed through the pin hole;

forming the stem to define a passage extending transversely through the stem from a front entry point disposed on the outer surface, to a rear exit point disposed on an opposing portion of the outer surface, the bridge pin being adaptable to receive an end of a musical string through the front entry point, through the passage, and out through the rear exit point to enable the string to pass through the bridge pin and into the pin hole along with the stem of the bridge pin;

defining a longitudinally disposed rear groove by arranging portion of the outer surface to form two planar walls intersecting to form a v-shaped groove for receiving a string in the groove along the walls, the rear groove extending from the rear exit point, longitudinally away from rear exit point to provide a seat for portions of the string disposed between the bridge pin and the walled opening that defines the pin hole; and wherein an end of a string can be frictionally secured and fixed to the musical instrument as the bridge pin is inserted into the pin hole to urge and force the string between a portion of the walls of the walled opening and the seat formed by the rear groove of the stem.

11. A method of making a string attachment system as recited in claim 10 further comprising the step of providing a bridge saddle for supporting strings at a spaced distance from the bridge assembly, the bridge saddle comprising a plurality of spaced v-shaped grooves defined by the intersection of two planar saddle walls, each groove disposed to receive one string through the groove so that a portion of the string is in contact with each planar saddle wall.

12. A method of making a string attachment system as recited in claim 11 further comprising the step of employing a nut for supporting strings at a spaced distance from a neck that extends from the body of the instrument, the nut comprising a plurality of spaced v-shaped grooves defined by the intersection of two planar nut walls, each groove disposed to receive one string through the groove so that a portion of the string is in contact with each planar nut wall.

13. A method of making a string attachment system as recited in claim 10 further comprising the step of employing a nut for supporting strings at a spaced distance from a neck that extends from the body of the instrument, the nut comprising a plurality of spaced v-shaped grooves defined by the intersection of two planar nut walls, each groove disposed to receive one string through the groove so that a portion of the string is in contact with each planar nut wall.

14. A method of making a string attachment system as recited in claim 10 wherein the stem of the bridge pin comprises a stem base and a terminal end that is removably attached to the stem base.

15. A method of making a string attachment as recited in claim 14 wherein the removable terminal end, of the bridge pin, is threadedly attached to the stem base.

16. A method of making a string attachment as recited in claim 15 wherein the removable terminal end, of the bridge pin end comprises a structure having at lease two opposing prongs.

17. A string attachment system for securing a string to a stringed musical instrument, the string attachment system comprising:

a bridge pin having an elongate stem defining an outer surface, the stem being adapted for longitudinal insertion into a pin hole defined by the walls of a walled opening provided through a bridge assembly disposed on the body of a stringed musical instrument, wherein the bridge pin is in removable mating engagement with the walls when disposed through the pin hole;

the stem being formed to define a passage extending transversely through the stem from a front entry point disposed on the outer surface, to a rear exit point disposed on an opposing portion of the outer surface, the bridge pin being adaptable to receive an end of a musical string through the front entry point, through the passage, and out through the rear exit point to enable the string to pass through the bridge pin and into the pin hole along with the stem of the bridge pin;

the stem further comprising a longitudinally disposed rear groove defined by a portion of the outer surface and formed by two planar walls intersecting to form a v-shaped groove for receiving a string in the groove along the walls, the rear groove extending from the rear exit point, longitudinally away from rear exit point to provide a seat for portions of the string disposed between the bridge pin and the walled opening that defines the pin hole, wherein an end of a string can be frictionally secured and fixed to the musical instrument as the bridge pin is inserted into the pin hole to urge and force the string between a portion of the walls of the walled opening and the seat formed by the rear groove of the stem;

a bridge saddle for supporting strings at a spaced distance from the bridge assembly, the bridge saddle comprising a plurality of spaced v-shaped grooves defined by the intersection of two planar saddle walls, each groove disposed to receive one string through the groove so that a portion of the string is in contact with each planar saddle wall; and a nut for supporting strings at a spaced distance from a neck that extends from the body of the instrument, the nut comprising a plurality of spaced v-shaped grooves defined by the intersection of two planar nut walls, each groove disposed to receive one string through the groove so that a portion of the string is in contact with each planar nut wall.

18. A bridge pin as recited in claim 17 wherein portions of the outer surface of the stem is tapered.

19. A bridge pin as recited in claim 18 wherein the stem comprises a stem base and a terminal end that is removably attached to the stem base.

20. A bridge pin as recited in claim 19 wherein the removable terminal end is threadedly attached to the stem base.

* * * * *